US005520840A

United States Patent [19]

Massaro et al.

[11] Patent Number: 5,520,840

[45] Date of Patent: May 28, 1996

[54] DETERGENT BARS COMPRISING WATER SOLUBLE STARCHES

[75] Inventors: Michael Massaro, Congers, N.Y.; Terence Farrell, Guttenberg; Gail B. Rattinger, Teaneck, both of N.J.; Michael Petko, Mt. Vernon, N.Y.

[73] Assignee: Lever Brothers Company, New York, N.Y.

[21] Appl. No.: 408,679

[22] Filed: Mar. 22, 1995

[51] Int. Cl.[6] ..... C11D 3/04; C11D 3/12; C11D 3/37

[52] U.S. Cl. ..... 252/174.17; 252/173; 252/174.21; 252/174.22; 252/DIG. 1; 252/DIG. 6; 252/DIG. 15

[58] Field of Search ..... 252/174.17, 174.21, 252/174.22, DIG. 1, DIG. 6, DIG. 15, 173

[56] References Cited

U.S. PATENT DOCUMENTS

| | | | |
|---|---|---|---|
| 2,987,484 | 6/1961 | Lundberg et al. | 252/174 |
| 5,225,097 | 7/1993 | Kacher et al. | 252/112 |

*Primary Examiner*—Anthony McFarlane
*Assistant Examiner*—Patricia L. Hailey
*Attorney, Agent, or Firm*—Ronald A. Koatz

[57] ABSTRACT

The present invention relates to synthetic detergent bars comprising 10–60% by wt. synthetic detergent surfactant; 10–60% of a water soluble structuring of water soluble structurant of MP between 40° to 100° C.; and 5–50% by wt. of a water-insoluble structurant of MP between 4°—100° C. Unexpectedly, applicants have found that addition of "true" water soluble starches yields processing and composition advantages.

4 Claims, No Drawings

DETERGENT BARS COMPRISING WATER SOLUBLE STARCHES

FIELD OF THE INVENTION

The present invention relates to soap bar compositions, especially to synthetic soap bar compositions. In particular, the invention relates to bar compositions comprising specific water soluble starches which unexpectedly have been found to provide superior bar properties (i.e., non-gritty surfaces when wetted under user conditions).

BACKGROUND OF THE INVENTION

Washing bars can be classified into three categories: (1) soap bars; (2) mixed active bars containing a significant proportion of soap; and (3) synthetic detergent bars containing only a small proportion of soap or none at all.

Conventional soap bars comprise a large proportion, typically 60–80% by weight, a fatty acid soap. Fatty acid soaps are selected to provide a balance of soluble and insoluble soaps which provide the required functional properties as regards lather formation and bar structure. Conventional soap bars are manufactured by milling, plodding and stamping a semi-solid mass of soap and other components.

Bars known which contain a mixture of soap and synthetic detergent where the amount of soap may be less than the amount of synthetic detergent, but is nevertheless still a significant contributor to the content of the bar. In such bars, as in conventional soap bars, the content of soap, especially the insoluble soap, contributes to the structure and physical properties of the bar.

The third category is synthetic detergent bars, often known as "Syndet" bars, in which there is no soap or only a small amount and the detergent active is mostly or wholly a synthetic, non-soap, detergent. Generally such bars contain a substantial proportion of material which is not a detergent, but which serves to give structure to the bar. Such "structurants" are normal water-insoluble and include such materials as starch and kaolin. The bars frequently also contain a plasticizer: known plasticizers include stearic acid and cetyl alcohol. Known surfactants for syndet bars include primary alkyl sulphates, alkyl ether sulphates, betaines, sarcosinates, sulphosuccinates and isethionates.

These syndet bars containing no soap or only a small proportion of soap are traditionally produced by energetic working of a physical mix of structurant (e.g., starch), plasticizer (e.g. stearic acid) and sudactant (e.g., acyl isethionate), i.e., both the soluble and insoluble components, in a high shear mixer to an end point at which the product is not gritty. The mix is then formed into 'syndet' bars.

The known process has several disadvantages in that the physical mixing step is performed batchwise and requires an energetic mixer.

In a copending case, U.S. Ser. No. 08/213,287 to Chambers et al. assigned to the same assignee as the subject invention, the inventors were able to dispense with the known energetic working step by using a specific combination of ingredients comprising:

(a) 10–60 by wt. of a synthetic non-soap surfactant (e.g., isethionate or SLES);

(b) 10–60% by wt. of a water-soluble structurant having a melting point in the range of 40°–100° C. (e.g., polyethylene glycol);

(c) 5–50% by wt. of a water insoluble structurant having a M.P. of 40°–100° by. wt.

(d) 0–20% by wt. water.

At page 8 of the specification it is said that water-insoluble structurant (component (c)) having a melting point above 100° C. may also be used (i.e., to strengthen bar and reduce smearing) but that it should comprise, if used at all, no more than 20% by wt. of the composition. Starches are one of the materials mentioned for possible use and it is noted that corn starches, for example, are preferred.

Unexpectedly, applicants have found not only that such starch materials are required (i.e, to increase mixer viscosity and billet hardness), but that not all starches are equal. That is, applicants have recognized that the starch must not be just a "partially soluble" material such as corn starch or potato starch but that it must be a "true" water soluble material such as, for example, maltodextrin in order to obtain user benefits (i.e., smoother, non-grittier surface).

By "true" soluble is meant the starch should dissolve to clear or hazy/clear solution at 10% by wt. or greater of the starch in water at room temperature (in contrast to other starches such as corn or potato starch which, at room temperature, swell, but which do not dissolve).

U.S. Pat. No. 2,987,484 to Lundberg, teaches a bar made by a closed die molding technique which bar comprises:

(1) about 35% to 70% of a normally solid, water-soluble, anionic synthetic surfactant; and (2) about 22% to 50% normally solid fatty vehicle with melting point between 120° F. and 220° F. selected from a group including higher fatty acids (e.g., stearic) and ethylene glycol.

In Lundberg, polyethylene glycol is not used at all as a water-soluble structurant (only ethylene or di-ethylene glycol). Although used as additives (additives are used up to about 10% according to column 12, line 72 and either 5% or 9.3% in Examples), they ordinarily are not used in an amount 10 to 60% as in the invention, let alone in preferred amounts of 20–50% by wt.

Lundberg is not concerned with the problem of energetic mixing (since it is a closed die molding technique) and simply does not recognize the advantage of using the water soluble structurants (e.g., PEG) of the invention in the amounts required. Further, Lundberg certainly does not teach or suggest that use of particular types of starches are also required or that some starches are better than others.

U.S. Pat. No. 5,225,097 to Kacher et al. teaches skin pH freezer bars comprising (1) 10 to 50% free fatty acids; (2) 15 to 65% of an anionic and/or nonionic bar firmness aid which may include PEG; and (3) 15 to 40% water; wherein the pH is about 4.8 to 6.0.

The bars of the subject invention cannot contain this amount of water because the bars would simply become too soft to process. The bars of the invention can have no more than 14% water content, preferably no more than 10% water.

The reference also clearly does not appreciate the need of added starch, nor that some starches are superior to others (i.e., the starches must be "truly" water soluble).

The unique combination of ingredients of the invention yielded a bar which is firmly structured and yet has a smooth non-gritty surface without excessive smear properties.

BRIEF SUMMARY OF THE INVENTION

The present invention provides a detergent composition which is, or can be shaped into, a synthetic detergent bar, the composition comprising:

(a) 10–60%, preferably 10–40%, more preferably 10–35% by weight of a synthetic, non-soap detergent;

(b) 10–60%, preferably 20–50% by weight of a water-soluble structurant which is neither soap nor a non-soap detergent and which has a melting point in the range 40°–100° C.;

(c) 5–50% by weight of a water-insoluble structurant which is neither soap nor a non-soap detergent and which has a melting point in the range 40°–100° C.;

(d) 1 to 25%, preferably 5 to 15% of a water soluble starch;

(e) 1 to 14%, preferably 1 to 9% by weight water;

wherein water-soluble is defined as dissolving to a substantially clear solution (except for small amounts of insoluble residue which may impart a translucent haziness to the otherwise clear solution) at 10% by wt. or greater of starch in water (i.e., at least 1 part in 10 should be soluble)

Suitable synthetic detergents (a) are: alkyl ether sulphates; alkylethoxylates; alkylethoxycarboxylates; alkyl glyceryl ether sulphonates; alpha olefin sulphonates; acyl taurides; methyl acyl taurates; N-acyl glutamates; acyl isethionates; anionic acyl sarcosinates; alkyl phosphates; methyl glucose esters; protein condensates; ethoxylated alkyl sulphates; alkyl polyglucosides; alkyl amine oxides; betaines; sultaines; alkyl sulphosuccinates, dialkyl sulphosuccinates, acyl lactylates and mixtures thereof. The above-mentioned detergents are preferably those based upon $C_8$ to $C_{24}$, more preferably those based upon $C_{10}$ to $C_{18}$, alkyl and acyl moieties.

For many embodiments of this invention, the amount of synthetic detergent (a) may lie in the range from 10 to 50% wt. Further preferences are at least 20% and not more than 40%, preferably not more than 35%.

The water soluble structurant (b) is required to melt in the temperature range from 40° C. to 100° C. so that it can be melted to form the bar composition but will be in a solid state at temperatures at which the bar will be used. Preferably it has a melting point of at least 50° C. to 90° C.

Materials which are envisaged as the wear soluble structurant (b) are moderately high molecular weight polyalkylene oxides of appropriate melting point and in particular polyethylene glycols or mixtures thereof.

Polyethylene glycols (PEG's) which are used may have a molecular weight in the range 1,500–10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a larger quantity of other water soluble structurant (b) such as the above mentioned polyethylene glycol of molecular weight 1,500 to 10,000.

Some polyethylene oxide polypropylene oxide block copolymers melt at temperatures in the required range of 40° to 100° C. and may be used as part or all of the water soluble structurant (b). Preferred here are block copolymers in which polyethylene oxide provides at least 40% by weight of the block copolymer. Such block copolymers may be used, in mixtures with polyethylene glycol or other water soluble structurant.

Preferably the total quantity of water soluble structurant (b) is from 20% to 50% by weight of the composition.

The water insoluble structurants (c) are also required to have a melting point in the range 40°–100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic, stearic, arachidonic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water soluble structurants (b) and water insoluble structurants (c) govern the rate at which the bar wears during use. The presence of the water insoluble structurant tends to delay dissolution of the bar when exposed to water during use and hence retard the rate of wear.

Preferably the total quantity of component (c) is from 10% to 40% by weight of the composition.

The present invention differs from copending U.S. Ser. No. 08/213,287 in that the subject invention requires at least some material which does not melt below 100° C. to function as additional bar structurant. This material should be present in an amount of at least 1% to 25% by wt. of the composition, preferably 5 to 15%.

This material must be a "true" water soluble material and, as such, does not include partially soluble starches such as the corn or potato starches, but instead the fully soluble starches, such as maltodextrin.

By water soluble is meant that a 10% by wt. or greater solution of the starch in water will dissolve to form a clear or substantially clear solution (except for small amounts of insoluble residue which may impart a translucent haziness to the otherwise clear solution).

The ratio of water soluble structurant (b) to the total of water insoluble structurants may possibly lie in a range from 2:3 or 1:1 up to 3:1 or 5:1.

Some soap, that is to say salts of monocarboxylic fatty acids having chain lengths of 8 to 22 carbon atoms may be included in the bar compositions of this invention. The amount is desirably not greater than 10% by weight of the composition.

We have found that if water insoluble soap is included, it is advantageous in reducing the wear rate of the bars. Such water insoluble soaps are salts of saturated fatty acids having chain lengths of 16 to 22 carbon atoms, especially 16 to 18. Preferably these salts are sodium salts.

If water insoluble soap is present in the composition, the amount of it desirably does not exceed 10% by weight of the composition, for example lying in a range from 3% to 9.5% by weight, more preferably 5% to 9%.

Materials which may be included, but which do not melt at temperatures below 100° C. can be classified as:

non soap synthetic detergent which does not completely liquify at temperatures below 100° C., for example acyl isethionates;

soap, especially water insoluble soap, which does not melt below 100° C.;

other water insoluble materials which do not melt below 100° C.

All percentages mentioned are intended to be by weight unless otherwise noted.

The following examples are meant for illustrative purposes only and are not intended to limit the claims in any way.

EXAMPLE 1

The following two formulations were fielded in consumer tests. Consumers (approx. 20) used each bar for two weeks and then offered their assessments in focus groups. The first bar (Bar A) contained insoluble potato starch. Consumer readily reported an unpleasant feeling of drag across the surface of the wetted bar, which was due to the presence of insoluble,swollen starch particulates. These starch particulates in the lather were clearly visible under the microscope. The second bar (Bar B ) contained the fully soluble maltodextrin. Consumers did not detect any indication of drag or grit on the surface of the wetted bars. No starch particulates were visible in the lather under the microscope. In a later, larger test involving 150 consumers, no drag or grit was detected from Bar B.

| Component | Bar A | Bar B |
|---|---|---|
| PEG 8000 | 39.46 | 35.00 |
| Na cocoyl isethionate | 27.00 | 27.00 |
| Palmitic-stearic acid | 8.58 | 9.00 |
| Coco amidopropyl betaine | 5.00 | 5.00 |
| Potato starch | 10.00 | — |
| Maltodextrin | — | 10.00 |
| Na stearate | — | 5.00 |
| Dimethicone | 0.25 | 0.25 |
| EHDP | 0.02 | 0.02 |
| EDTA | 0.02 | 0.02 |
| Fragrance | 0.25 | 0.25 |
| Titanium dioxide | 0.50 | 0.50 |
| Misc. salts | 2.92 | 1.96 |
| Water | 6.00 | 6.00 |

These tests clearly show that, in a bar where the primary difference was the difference in starch used, use of a water soluble starch such as maltodextrin rather than a starch like potato starch unexpectedly provided tremendous advantages in the consumer perception of "grittiness" or drag.

We claim:

1. A detergent composition which is, or can be shaped into, a synthetic detergent bar, the composition comprising:

(a) 10–60% by weight of a synthetic, non-soap detergent;

(b) 20–60% by weight of a water soluble structurant which has a melting point in the range 40–100° C. and which is selected from the group consisting of one or a mixture of polyalkylene oxides having a molecular weight in the range of 1,500 to 10,000; and block copolymers of polyethylene oxide and propylene oxide;

(c) 5–50% by weight of a water-insoluble structurant which has a melting point in the range 40°–100° C. and which is a fatty acid having a carbon chain length of 12 to 24 carbons;

(d) 1 to 25% of a water soluble starch; and (e) 1–14% by weight water;

wherein 10% or greater of said water soluble starch will dissolve in water to form a clear or translucent solution.

2. A composition according to claim 1, which comprises 10–40% by wt. non-soap detergent.

3. A composition according to claim 1, which comprises 20–50% by wt. water soluble structurant (b).

4. A composition according to claim 1, which comprises 5 to 15% by wt. water soluble starch (d).

* * * * *